United States Patent [19]

Hauser et al.

[11] 4,161,265

[45] Jul. 17, 1979

[54] DEVICE FOR DISPENSING POWDERED MATERIAL

[75] Inventors: Stephen G. Hauser, Tarzana; Keith S. Keith, Los Angeles, both of Calif.

[73] Assignee: United States Borax & Chemical Corporation, Los Angeles, Calif.

[21] Appl. No.: 833,184

[22] Filed: Sep. 14, 1977

[51] Int. Cl.[2] ..... G01F 11/24

[52] U.S. Cl. ..... 222/181; 222/339; 222/363

[58] Field of Search ..... 221/266, 276, 283; 267/158; 222/181, 339, 362, 363, 364, 517, 531, 543 (U.S. only)

[56] References Cited

U.S. PATENT DOCUMENTS

| | | | |
|---|---|---|---|
| 896,759 | 8/1908 | Robinson | 222/364 X |
| 2,121,516 | 6/1938 | Woo | 222/363 X |
| 2,165,933 | 7/1939 | Martin | 222/363 X |
| 3,297,208 | 1/1967 | Swett | 222/543 X |
| 3,568,893 | 3/1971 | Becker | 222/363 |
| 3,622,048 | 11/1971 | Batlas | 222/181 |
| 3,840,154 | 10/1974 | Speak | 222/181 |

*Primary Examiner*—David A. Scherbel

*Attorney, Agent, or Firm*—Eric P. Schellin; Horace S. Harper; James R. Thornton

[57] ABSTRACT

There is disclosed a powder dispenser having a support for retaining an inverted opened rigid container of powdered material, such as powdered soap or detergent. The dispenser has a funnel-like arrangement terminating in a downwardly facing opening. Positioned thereunder is a trap chamber into which an amount of the powdered material is accumulated. The trap chamber is suitably journalled whereby it may rotate through a relatively small angle and also has a downwardly extending lever to manipulate the trap chamber whereby the powdered material therein may be discharged therefrom a leaf spring is provided to urge the trap chamber to its normal position to receive the powdered material.

7 Claims, 7 Drawing Figures

DEVICE FOR DISPENSING POWDERED MATERIAL

BACKGROUND OF THE INVENTION AND FIELD OF THE INVENTION

The present invention relates to that class of devices useful in dispensing or metering small uniform quantities of powdered or particulate cleaning material, such as powdered soap or powdered detergent. In workshops, laboratories, repair shops and similar working zones clean-up areas have been set aside. Such clean-up rooms are frequented by many individuals who require access, for instance, to cleansing material. Providing soap and detergent bars for multiple use poses many problems as many individuals dislike employing a soap bar which had been used only a short time before by someone else, who may leave a wet soggy soap bar. To obviate this problem to a degree, powdered soap dispensers have been provided which possess a reservoir that must be filled from a container. It is an advantage to employ a dispenser that uses the container having the powdered material as the reservoir whereby no prefilling is necessary.

Another problem frequently encountered in regard to powdered soap dispensers that are usually constructed of metal is the unfortunate fact that the metal will tend to corrode. Powdered detergent and soap material is generally quite alkaline and is also usually hygroscopic. As a result of this the metal will become corroded and the powdered material will often cake around the moving parts. Corrosion can be alleviated by employing all or mostly plastic parts. The problems attendant caking may be diminished by employing as few parts as possible.

It will be seen, therefore, from the following that the field of the invention pertains to means useful in dispensing relatively small increments of a powdered material preferably a powdered soap or powdered detergent directly into the hand or hands of an individual from its container. Additionally, suitable bracket means is included whereby the device may be conveniently removably affixed to a wall or the like.

A prior art U.S. patent to the same assignee for dispensing a viscous material is U.S. Pat. No. 3,840,154. The device disclosed thereby is quite complex requiring many parts and is subject to myriad problems.

Other prior art devices having means for dispensing a quantity of particulate material from a source are U.S. Pat. Nos. 2,797,848; 2,873,050 and 3,252,632.

DETAILED DESCRIPTION OF THE DEVICE

Figure 1:
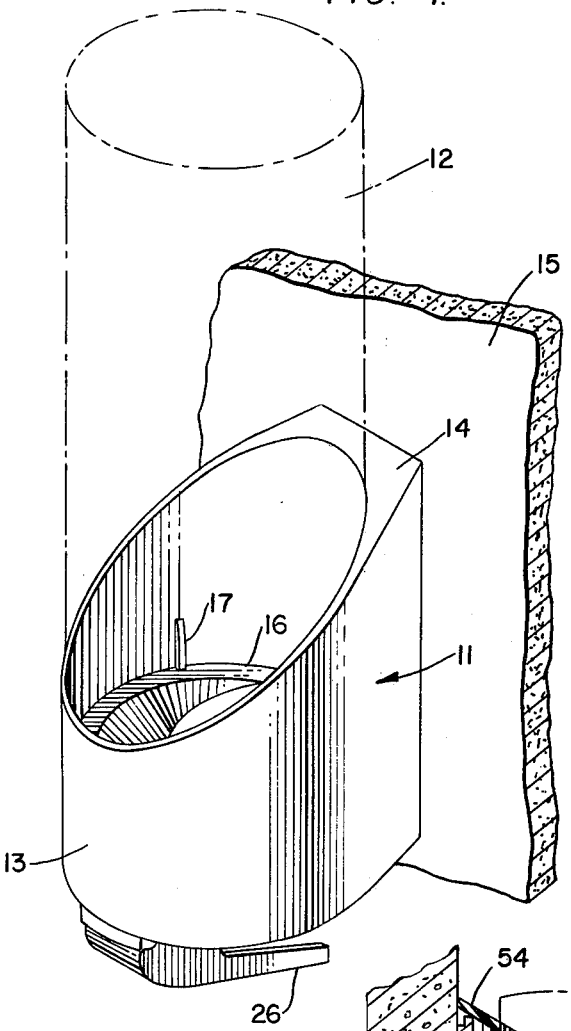
FIG. 1 is a perspective view of the device.
Figure 2:
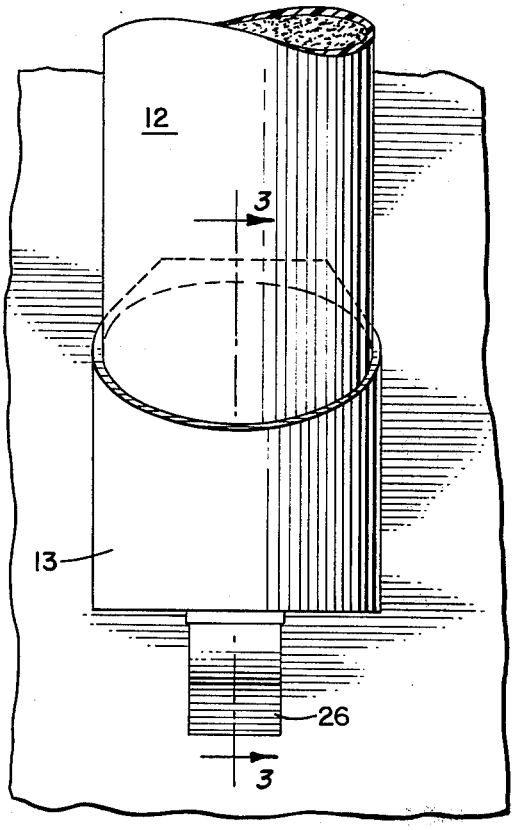
FIG. 2 is a front elevation view of the device.

Turning to FIGS. 1 and 2 for an initial description of the invention, reference numeral 11 refers, generally, to the device of the present invention. It will be seen that the device 11 presents an attractive appearance. The cylindrical object shown by the dotted lines refers to an inverted container 12 for containing the powdered soap material, for instance, for dispensing. The container is a can which is opened in a conventional manner, then inverted and positioned upside down as seen in FIG. 1.

The device possesses upstanding annular wall 13, which has an internal diameter slightly larger than the external diameter of the container 12. It will be seen that the annular wall 13 is lower in the front and increases in height towards the back. The annular wall 13 has a flattened appendage 14 integral therewith, for instance, so that the device may be attached to a hereinafter disclosed bracket and may therethrough be mounted on a wall. It is partially for this reason that the annular wall 13 is higher at the back. Another reason is to provide for easier insertion of the container from the front into the position, as shown.

The device has an annular floor 16 on which the inverted container is permitted to rest in the aforementioned inverted position. Especially from FIG. 1, one can note one of the plurality of short vertical ridges 17 on the internal surface of the upstanding wall 13 terminating at its lowermost end with the annular floor 16 and terminating in a cam surface at the other end. These ridges are designed to firmly grasp the container so that it is not easily dislodged should it be inadvertently struck during use.

Figure 3:
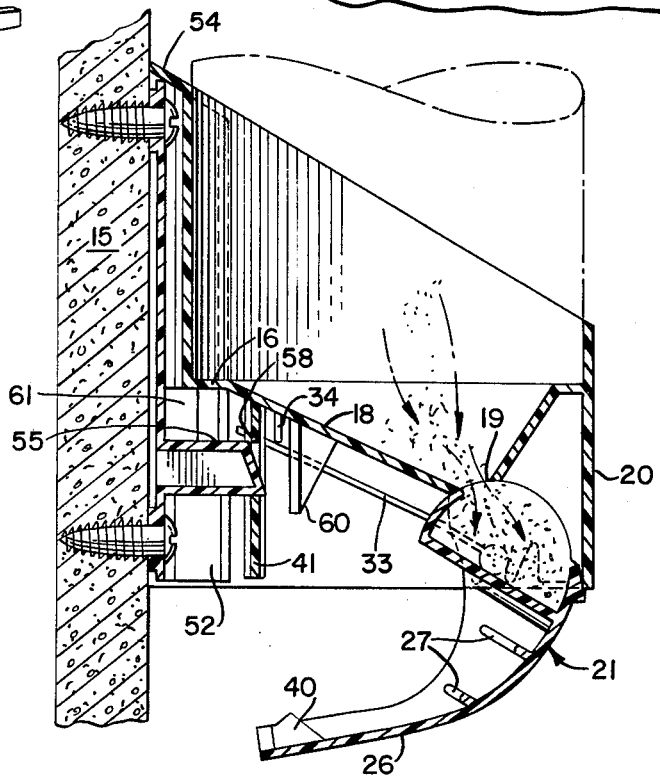
FIG. 3 is a cross-sectional view taken along line 3—3 of FIG. 2.
Figure 4:
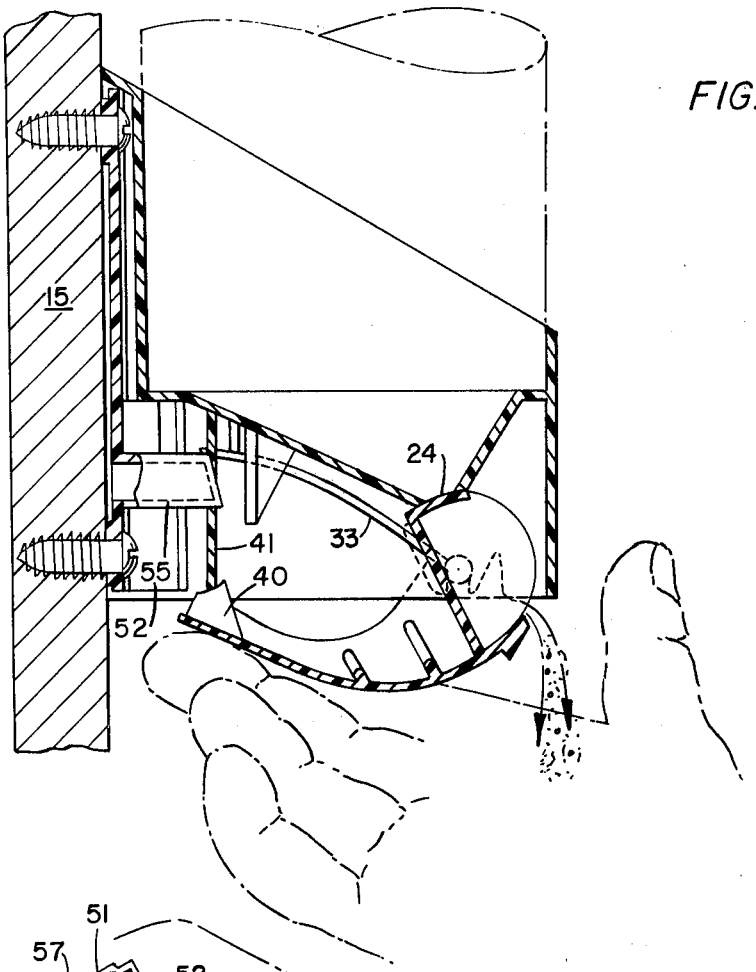
FIG. 4 is a similar view as FIG. 3 showing the device in operation.
Figure 7:
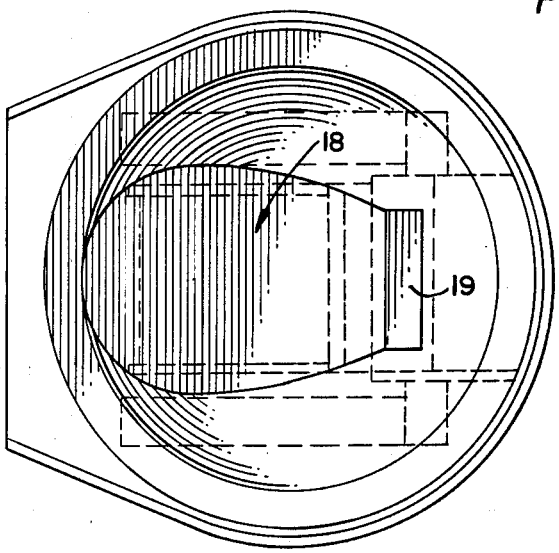
FIG. 7 is a top plan view.

Central of the annular floor 16 and integral therewith is a funnel-like arrangement 18 having a rectangularly shaped aperture 19 somewhat towards the front of the device as seen in FIGS. 3, 4 and 7. It will be noted therefore that the funnel is asymmetrical in configuration. It will be further noted that the funnel-like arrangement 18 cannot be seen from the side or the front as upstanding wall 13 has a downwardly depending skirt portion 20 that not only hides from view the funnel arrangement but also the major part of the operative dispensing means 21 as will now be described.

Figure 5:
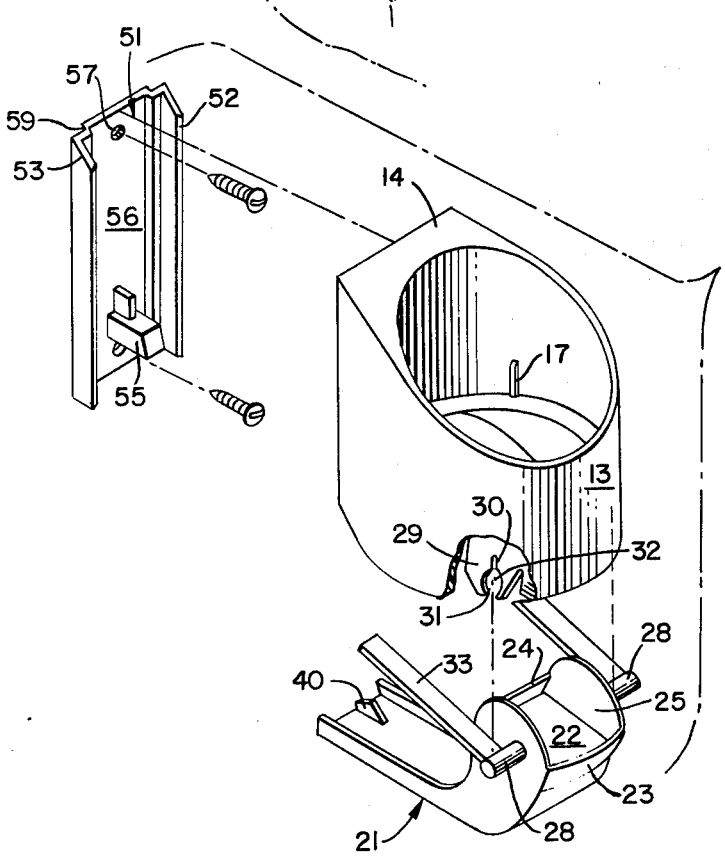
FIG. 5 is a perspective exploded view of the parts of the device.

Positioned below the funnel arrangement 18 is the dispensing means 21. It has an elongated somewhat arcuate configuration as can be readily observed from FIGS. 3, 4 and 5. At the uppermost end thereof the dispensing means forms a trap chamber 22 open at its most distal end, formed by slightly rounded front wall 23, rear wall 24 and two higher side walls 25 having arcuate upwardly extending leading edges, while in the embodiment herein described the front and back walls have linear upwardly extending leading edges.

The length of the longest dimension of the rectantularly shaped aperture 19 is somewhat less than the linear distance between the two side walls 25 of the dispenser. The upwardly facing leading edge is in sliding contact with the underside 19A of the funnel so that the trap chamber 22 is effectively sealed and leakage of the particulate material is avoided; see FIG. 6 for the means for the aperture where the dispensing means 21 has been removed.

The other end portion of the dispensing means 21 comprises a U-shaped arcuate lever 26 which extends rearwardly. It will be noted that the lever 26 possesses a number of reinforcing ribs 27. The aforementioned side walls 25 each have on their respective outwardly extending surfaces a horizontally extending stub 28, integral with said side walls, as in this embodiment the dispensing means 21 is constructed of a suitable plastic.

At a portion of the underside of the funnel arrangement 18, and at a portion of the annular wall and internally of a portion of the skirt 20 there are two spaced apart depending journalling means 29. The said journalling means 29 are positioned in each side of side walls 25 in the manner noted hereinafter. As will be noted, especially from FIG. 5, each of the journalling means comprises a wall having a vertical slot 30 having a downwardly facing opening 31 which is somewhat smaller than the diameter of the aforementioned stub 28. Each of the slots 30 also possesses an enlarged rounded wider portion 32 adapted and constructed so that each receives one stub 28 of the dispensing means 21 which is assembled by thrusting the stubs through the opening 31 to temporarily widen the slot 30 until the stubs are seated in the rounded wider portion 32 and is thereby in journalling arrangement therein. The journalling means 29 is integral with the device of the present invention and is constructed of a plastic material having a sufficient degree of resiliency to momentarily accept distension when the dispensing means 21 is assembled as herein contemplated.

Also integral with each stub 28 is a rearwardly extending elongated flexible spring means 33. Each of the spring means is in abutment with a downwardly depending stop means 34 near one end portion. The said stop means 34 depends from the underside of the funnel arrangement as will be noted from FIGS. 3 and 4. The spring means is designed to normally maintain the dispensing means 21 in the position of FIG. 3; that is, in a non-tension position whereby the trap chamber 22 in in communication internally with the funnel arrangement 18 through aperture 19. In this position the outside of front facing wall 23 is in abutment with a portion of the inside of the skirt 20.

It will indeed be appreciated that the particulate or powdered soap or detergent in the funnel arrangement 18 as a result of it being charged thereinto from the container 12 will fill trap chamber 22, as shown in FIG. 3. The contents of trap chamber 22 are emptied therefrom as shown in FIG. 4 where the lever 21 is thrust upwardly manually as shown whereby the contents in the trap chamber 22 are spilled thereout. When this occurs it will be seen that rear wall 24 closes aperture 19 thereby effectively metering out only that particulate material already in the trap chamber. Spring means 33 is flexed. The progress of the lever is permitted to the extent shown where stop means 40 near the end portion of lever 26 abuts against the end of downwardly depending flexible wall 41 which is integral with the underside of the funnel arrangement. Release of lever 26 will result in the return of the dispensing means to the position illustrated in FIG. 3 due ot the aegis of the spring means 33, whereby the trap chamber again becomes charged with soap or detergent as a result of gravity flow.

Having discussed the device of the present invention, attention is now directed to the mounting means usefully employed to secure the device of the present invention to a vertical wall while at the same time making it entirely possible to easily remove the device for servicing or replacement as desired. A wall bracket 51 is provided as can be seen from FIGS. 3 and 4, in cross-section and in perspective in FIG. 5. Note that it has a U-shaped configuration having forwardly facing legs 52. The upwardly leading edges 53 of the wall bracket are seen to be sloping downwardly as they extend forwardly thereby being adapted and constructed to abut internally on the underside of rearwardly extending skirt 54 of the aforementioned flattened appendage 14 to thereby assist in supporting the device 11. The rearwardly extending portion of the housing has a slot which is open at the bottom. The edges of the said slot are adapted and constructed to fit behind offset portion 59 of the web 56 when the device is slid onto the bracket. Further support is given to the device by means of forwardly facing rectangularly shaped stub 55 which extends from the web portion 56 of the bracket near the bottom thereof. The web portion 56 also has a plurality of vertically spaced apart apertures 57 for screws to secure the bracket to a wall as shown in FIGS. 3 and 4. The aforementioned downwardly depending wall 41 possesses an aperture 58 of sufficient dimension to accept the stub 55. In assembling the device to the bracket, the device is slid downwardly onto the bracket, the flexible wall 41 is flexed forwardly until the stub 55 and the aperture 58 of wall 41 are in proper alignment whereupon the wall and stub are snapped together.

Figure 6:
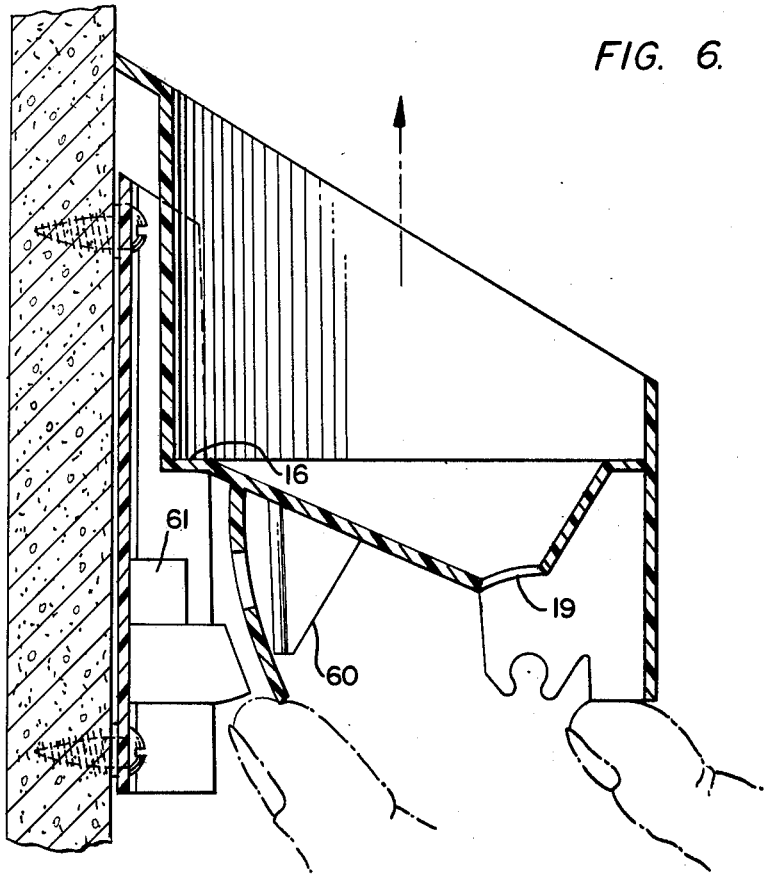
FIG. 6 is a cross-sectional view similar to FIG. 3.

In order to control the extent of the flex of the depending wall 41, two downwardly depending abutments 60 are provided, as can be seen from FIG. 6, especially. Two abutments are provided so that they provide excellent control and at the same time avoid interference with stub 55 and the aperture 58 of the depending wall 41. In FIG. 6, the device 11 is being slid downwardly onto the bracket. Note also the extending portion 61 above stub 55, a portion of the upward leading edge thereof is in abutment with the underside of the annular floor 16 when the device and the bracket are fully assembled as shown in FIG. 3.

The simple fact of sliding the device onto the bracket will cause the forwardly facing and sloping surface of the stub 55 to flex the wall 41 until the aperture 58 and the stub are in alignment whereupon the flexed wall 41 will snap back and stub 55 will protrude into aperture 58. To remove the device, it is first released from the stub of the bracket by again flexing wall 41 forwardly and then the device is moved or slid upwardly for a distance until it is disengaged from the wall bracket which remains attached to the wall.

When the device is properly assembled the wall bracket cannot be discerned as noted from FIG. 1, thereby providing a rather pleasing appearance. From the foregoing, it will be appreciated that the present invention is constructed of only three parts if one considers the wall bracket part of the total invention and only two parts when one does not consider the wall bracket in the totality of the invention. As has been clearly stated, the parts of the invention are constructed of plastic so that inexpensive molding techniques are contemplated in the fabrication of the invention.

What is claimed is:

1. A two piece molded dispenser comprising a housing provided with an upstanding top portion having an upwardly extending wall for retaining an inverted container of particulate material to be dispensed, said housing having a funnel means terminating in an orifice, journalling means in said housing positioned below said funnel means, and stop means positioned below at least a portion of said funnel means; and an integrally formed dispensing means including horizontal stub means and at least one elongated leaf spring means, said dispensing means having a normally upwardly facing open trap chamber means and being in receiving relationship with said orifice, said dispensing means having a downwardly depending manually operated lever means, said trap chamber means of said dispensing means having said horizontal stub means positioned for rotatable mounting in said journalling means, said at least one elongated leaf spring means extending at one end from said stub means and the other end having a portion in abutment with said stop means, said leaf spring being in a non-tension position when said trap chamber of said dispensing means is in a non-dispensing position, and said trap chamber means having a rear wall which co-operates with said orifice in the non-dispensing position of said trap chamber to prevent particulate material from spilling out of said trap chamber and to close said orifice in the dispensing position of said trap chamber.

2. The dispenser of claim 1 wherein the journalling means includes spaced apart downwardly depending wall means having a downwardly facing open slot narrower than the diameter of the horizontal stub axle and said slot has a wider portion adapted and constructed to normally rotatably retain said stub axle of said dispensing means when said dispenser is in an assembled condition.

3. The dispenser of claim 2 wherein said dispenser has an elongated vertical bracket means for attachment to a wall.

4. The dispenser of claim 3 wherein the dispenser at its top portion has an upwardly and rearwardly facing skirt, said bracket means has an upwardly facing portion that slopes downwardly forwardly adapted to lie in supporting relationship at the underside of said skirt, said bracket means having a forwardly facing stub, said dispenser having a flexible depending wall means from the underside of said funnel means, said wall means having an aperture, said stub and said aperture of said wall means adapted and constructed to snap together whereby said stub is secured in said aperture of said wall means.

5. The dispenser of claim 4 wherein said dispenser is constructed of three parts, said housing being one part, said dispensing means being a second part and said bracket means being the third part.

6. The dispenser of claim 4 wherein the top portion has an annular floor for supporting said container.

7. The dispenser of claim 6 wherein internally of the top portion at least one rib is provided proximate the said annular floor adapted and constructed to embrace said container.

* * * * *